US006634374B1

(12) United States Patent
Kondas et al.

(10) Patent No.: US 6,634,374 B1
(45) Date of Patent: Oct. 21, 2003

(54) IN GROUND HOSE WELL

(76) Inventors: Larry R. Kondas, 4920 Adams St., Hollywood, FL (US) 33021; Robert N. Sanford, 7711 NW. 15th St., Pembroke Pines, FL (US) 33024

( * ) Notice: Subject to any disclaimer, the term of this patent is extended or adjusted under 35 U.S.C. 154(b) by 0 days.

(21) Appl. No.: 10/113,589

(22) Filed: Mar. 28, 2002

(51) Int. Cl.[7] ..... G05D 7/00

(52) U.S. Cl. ..... 137/15.01; 137/355.16; 137/355.28; 137/363; 137/371

(58) Field of Search ..... 137/363, 371, 137/355.28, 355.16, 15.01

(56) References Cited

U.S. PATENT DOCUMENTS

| | | | | | |
|---|---|---|---|---|---|
| 1,532,177 | A | * | 4/1925 | Gist | 137/355.28 |
| 2,367,141 | A | * | 1/1945 | Rosenblum | 137/355.16 |
| 2,871,057 | A | * | 1/1959 | Bernyk | 137/355.26 |
| 3,672,103 | A | * | 6/1972 | Kost | 52/20 |
| 3,715,958 | A | * | 2/1973 | Crawford et al. | 52/21 |
| 3,939,862 | A | | 2/1976 | Booth | 137/355.16 |
| 4,588,083 | A | | 5/1986 | Hunt | 248/79 |
| 5,568,824 | A | | 10/1996 | Cordrey | 137/355.27 |
| 5,678,596 | A | | 10/1997 | Corallo | 137/357 |
| 5,678,599 | A | | 10/1997 | Moss | 137/377 |
| 6,182,327 | B1 | | 2/2001 | Gosselin | 15/315 |

* cited by examiner

*Primary Examiner*—A. Michael Chambers
(74) *Attorney, Agent, or Firm*—Kevin P. Crosby, Esq.; Brinkley, McNerney, et al.

(57) ABSTRACT

A corrosion resistant enclosure adapted to be recessed below the ground which allows a covering lid to be placed about an opening at the upper end of the housing substantially parallel to the surrounding terrain. The housing is preferably cylindrically shaped, having a larger diameter at the bottom than at the top. However, the housing may take any desired shape, such as rectangular, elliptical, cubic, etc without departing from the intended scope of the invention. The housing also includes a supply of pressurized water which is hooked up to the supply of water previously utilized for the above-ground stored garden hose through any conventional plumbing arrangement. Preferably, valving is utilized within the housing, and a threaded male brass fitting supplied to attach the proximal end of the hose to within the housing.

9 Claims, 7 Drawing Sheets

IN GROUND HOSE WELL

BACKGROUND OF THE INVENTION

1. Field of the Invention

This invention relates to storage devices, and in particular relates to an in-ground well adapted to receive a garden hose coiled about a vertical axis connected at its proximal end to a supply of pressurized water.

Homeowners put much effort into maintaining their home in a tidy fashion. The garden hose can be a source of much frustration, particularly when it comes to storing same.

Reels and other above-ground hose organizers are well known, usually placed adjacent to the water spigot or in garages, sometimes in numerous locations near the house. Unfortunately, the hose and reel or other storage device take up unnecessary space and create an unsightly appearance, detracting from the appearance of the property. In addition, a hose lying on the ground, whether coiled or not, or storage devices therefore, also create a safety hazard, since it is easy for one to trip over such unnecessary obstacles.

Numerous devices have been developed for storing hoses over the years ranging from a simple device mounted to an exterior wall of the house to revolving reels, mostly above-ground.

In each of the above-ground hose storage solutions, the hose is still generally stored outdoors, where it detracts from the decor of the house and is vulnerable to theft or other damage, such as damage caused by ultra violet radiation from the sun. While the hose may alternatively be stored indoors, the retrieval of the hose from its indoor storage area and deployment outdoors, and the reversal of the procedure when the task is over, unnecessarily complicates the task. Attempts have been made to store the garden hose below the ground so as to overcome the above-mentioned shortcomings in prior art storage techniques. One example is found in U.S. Pat. No. 5,568,824 to Cordrey, which discloses a below-ground mounted hose reel and housing therefore, in which the hose is mounted on an electrically actuated self-retracting reel, and further in which the hose is deployed and retracted through a small aperture in a cover of the housing and the supply of water is engaged and disengaged via a remote electrical actuator. Not only is the system disclosed in the Cordrey patent complicated and, consequently, unduly expensive but the coiling of a hose about a reel which cannot be accessed unless the device is taken apart presents obvious and undesirable risks.

Another example of a below-ground hose storage device is found in U.S. Pat. No. 5,678,599 to Moss. Moss discloses a box-like enclosure, recessed below ground surface, with a hose reel pivotally mounted therein for movement between a stored position within the housing and a deployed position external to the housing. As with the Cordrey device, the Moss device uses a hose storage reel whereby the hose is stored about a horizontal axis and must be wrapped around the reel by manual cranking of a handle attached to the reel.

Neither device permits the user to simply manually place the garden hose into the housing by a simple coiling action about a horizontal axis. A more simplified solution is called for than has heretofore been presented.

2. Description of the Prior Art

SUMMARY OF THE INVENTION

It is, therefore, a principal object of this invention to provide a garden hose storage system which holds the hose in an isolated condition and which permits the hose to be retained in a minimal amount of space, without the possibility of becoming accidentally uncoiled or getting in the way of other activity in the storage area.

Another object of the invention is to provide a garden hose storage container which is simple in design, inexpensive to manufacture, rugged in construction, easy to use and efficient in operation. This invention accomplishes the desired result by providing a corrosion resistant enclosure adapted to be recessed below the ground,which allows a covering lid to be placed about an opening at the upper end of the housing substantially parallel to the surrounding terrain. The housing is preferably cylindrically shaped, having a larger diameter at the bottom than at the top. However, the housing may take any desired shape, such as rectangular, elliptical, cubic, etc without departing from the intended scope of the invention. The housing also includes a supply of pressurized water which is hooked up to the supply of water previously utilized for the above-ground stored garden hose through any conventional plumbing arrangement. Preferably, valving is utilized within the housing, and a threaded male brass fitting supplied to attach the proximal end of the hose to within the housing.

Also preferably but not by way of limitation, a grate or other drainage feature is provided below an open bottom end of the housing to permit water to drain off instead of being trapped within the housing.

A removable lid, or alternatively a hinged lid, is provided which should be strong enough to withstand the weight of any devices which may be driven there such as lawn mowers, or even motor vehicles.

The hose may be coiled into or pulled out of the housing on demand. The tapered shape of the housing facilitates the coiling process when the hose is being stored.

These and other objects and features of the invention will be more readily understood from a consideration of the following detailed description, taken with the accompanying drawings, in which corresponding parts are indicated by corresponding numerals.

DETAILED DESCRIPTION OF THE PREFERRED EMBODIMENT

Figure 1:
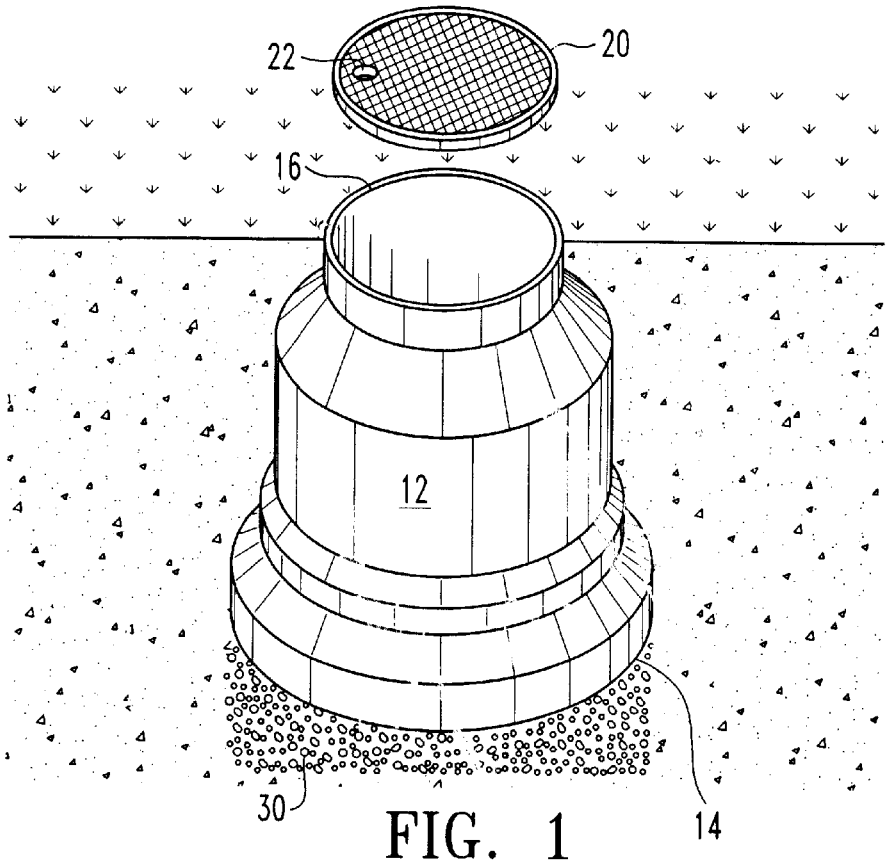
FIG. 1 is a perspective view of a first embodiment of the invention.
Figure 2:
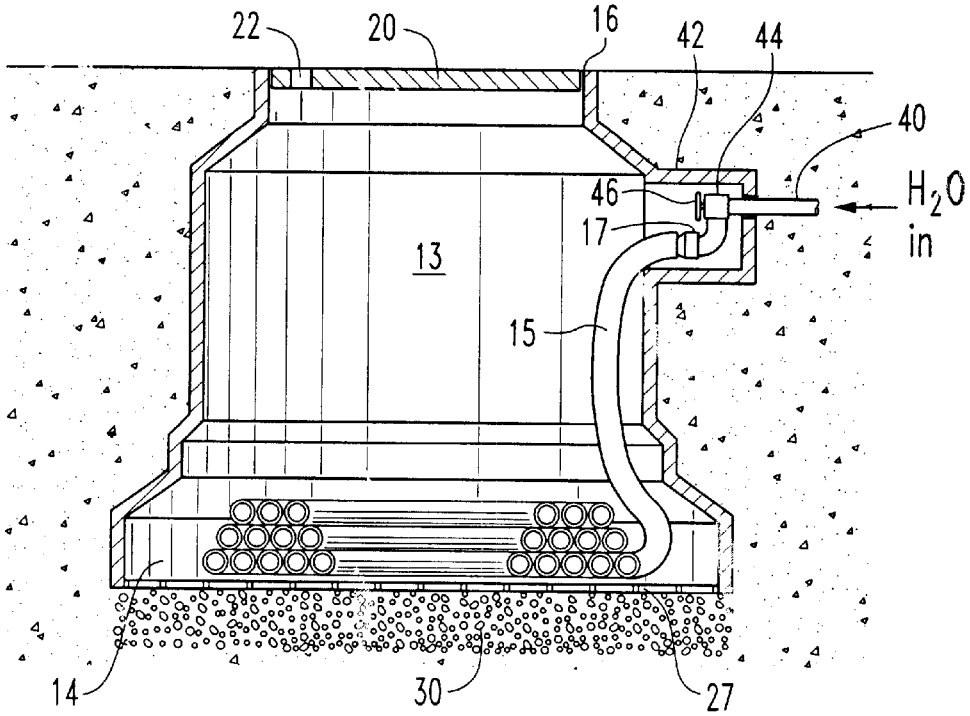
FIG. 2 is a cross-sectional elevational view of the first embodiment of the invention.
Figure 3:
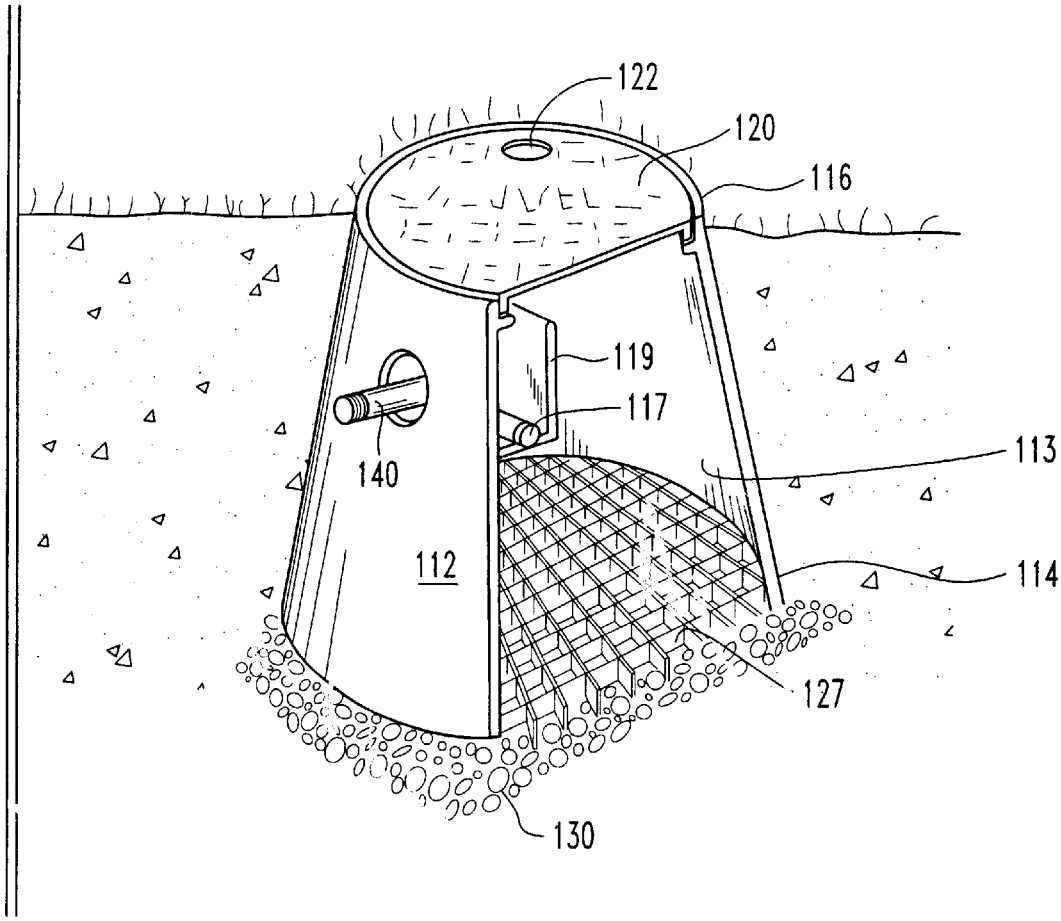
FIG. 3 is a perspective, partial cut-away, view of a second embodiment of the invention.
Figure 4:
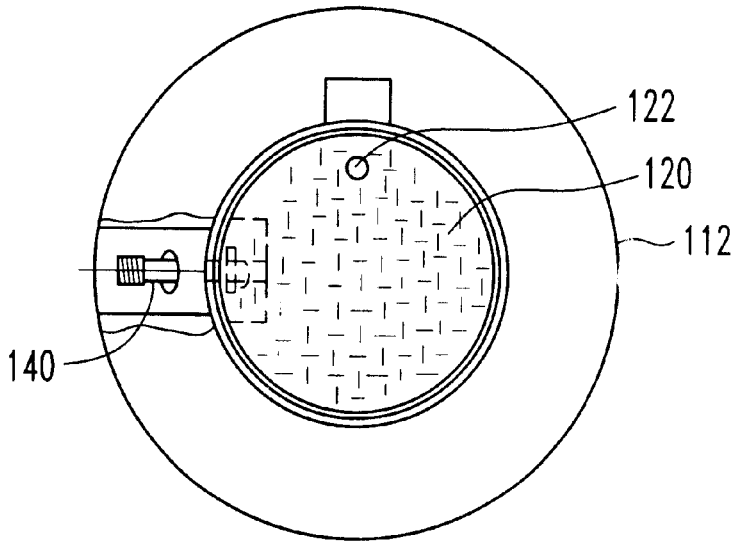
FIG. 4 is a top plan view of the second embodiment of the invention.
Figure 5:
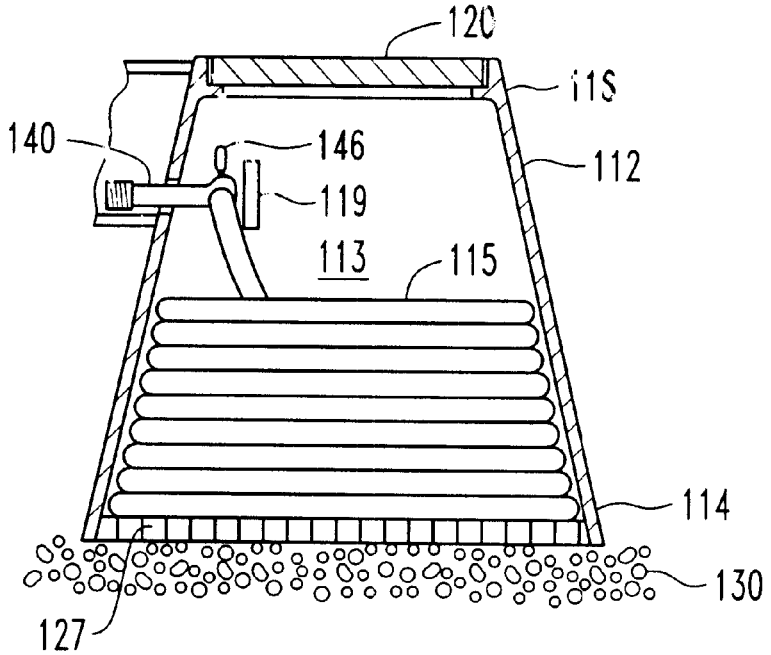
FIG. 5 is a cross-sectional elevational view of the second embodiment of the invention.
Figure 6:
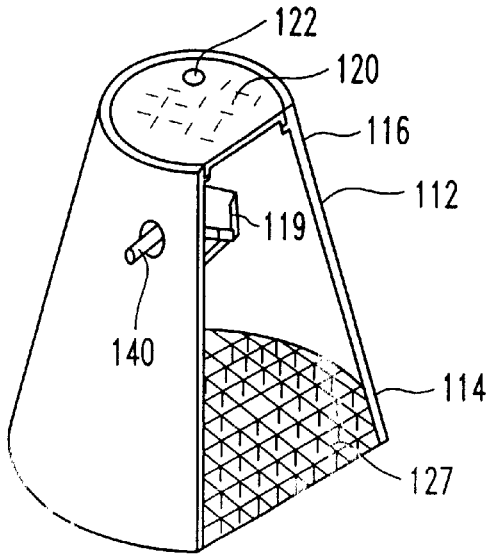
FIG. 6 is a perspective, partial cut-away view of the second embodiment of the invention.

Referring now to the drawings, FIGS. 1–2 show the preferred form of the invention which is comprised of a generally cylindrically shaped housing 12 having an open bottom end 14 and an open upper end 16 and a lid 20 adapted to fit flush with the upper end 16 of housing 12 at essentially ground level (as shown in FIG. 2). A finger-sized opening 22 is provided in top 20 to permit the top to be removed from the upper end 16 of housing 12.

As can be seen, housing 12 is adapted to be installed below-ground, with its upper end 16 being essentially coincident with the ground surface.

Open bottom end 14 is adapted to sit atop, or be placed in registry with, some form of drain or drain field 30 so that any water which finds its way into the interior 13 of housing 12 will drain off due to gravity.

A standard garden hose (or any other type of hose desired) 15 can be coiled within the interior 13 of housing 12 as shown. The tapering structure of housing 12 facilitates the easy spooling of the hose within housing 12 upon placement of the hose in coiled fashion there within.

Preferably, a water supply is provided to the interior 13 of housing 12 to completely hide the hose from view when it is stored, and to provide a ready to go hose assembly without the necessity of having to connect the proximal end 17 of hose 15 to a spigot attached to the house (exterior to housing 12).

To this end, a water supply line 40 from any conventional water source is directed to a recess 42 defined by housing 12, where it is connected to the proximal end 17 of hose 15. A valve 44 is provided having valve actuator 46, such as a handle or knob.

To utilize the hose one needs merely remove top 20, reach into housing 12 and turn on the flow of water by turning actuator 46, then removing the hose from housing 12. Obviously any length of hose 15 may be employed, and for application where substantial or abnormally long lengths of hose are needed, housing 12 should be dimensioned accordingly.

As can be seen, the invention provides a concealed and protected hose storage facility which is permanently installed in a concealed location, ideally beneath the surface of the ground. However, the device may be employed in an above-ground manner either outdoors or built in to a building structure. The device provides an excellent means of protecting and storing a garden hose or the like, while at the same time providing ready access thereto. The device protects the hose from exposure to damaging environmental agents such as ultra violet radiation, lawn equipment, animals and even low temperature. Since the temperature below ground is typically higher than the ambient temperature in cold climates the hose in most settings will be kept free from freezing, which can be a particular hazard to the hose should the hose be filled with water. The employment of an open bottom to housing 12 and a natural drain there below permits the user to keep the hose clean by hosing it off once it is coiled within the housing without fear of the pooled water creating the undesirable conditions associated with accumulated water.

Referring now to FIGS. 3–8, a second embodiment of the invention is shown in which a generally downwardly tapering housing 112 having an open bottom end 116 and an open top end 116 is shown. A drainage grate 127 acts as a floor associated with the bottom 114 of housing 112. A drainage medium 130 such as crushed stone to facilitate drainage of water from the interior 113 of housing 112.

A supply of water is provided by water inlet 140. A coupling 117 is provided to which can be attached a hose 115. Hose 115 conveniently spools within housing 112 for storage below ground. A lid 120 is provided with a handle or other grasping means 122 to permit lifting of lid 120 to obtain access to interior 113 of housing 112.

A valve 146 may be provided to permit a user to turn a flow of water to hose 115 on and off. A barrier 119 is provided, which minimizes the chances that hose 115 will become hung-up or snagged upon valve 146 while being placed into or removed from housing 112.

Figure 7:
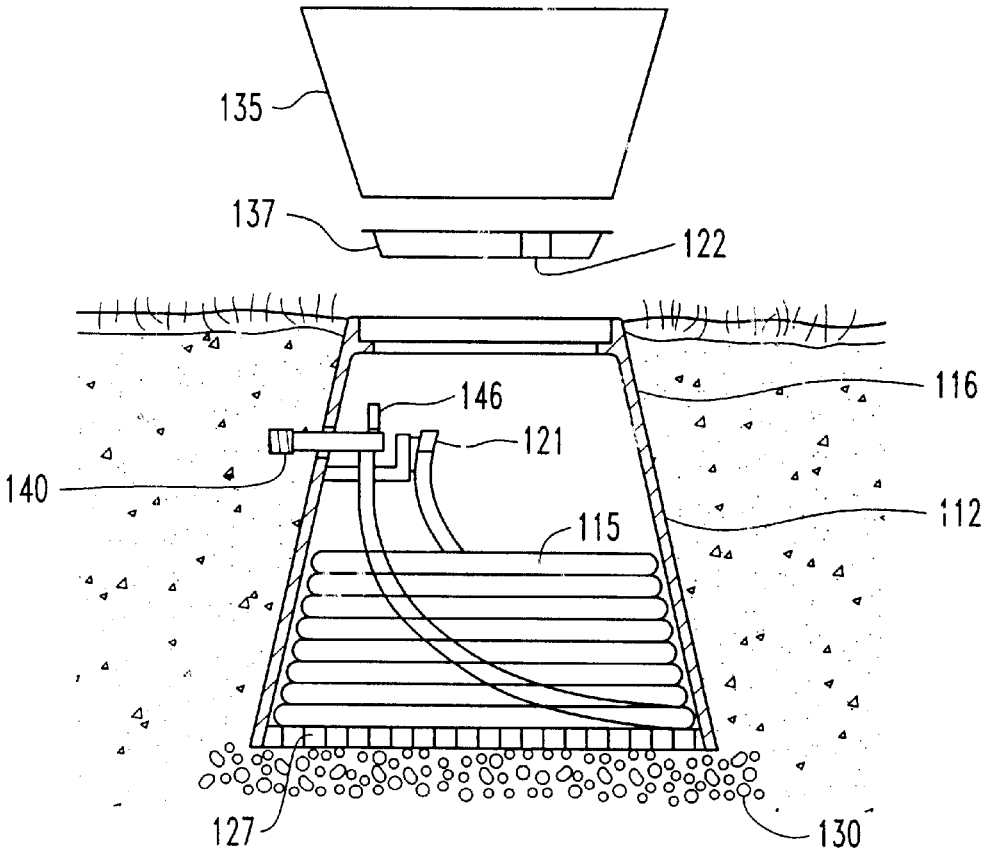
FIG. 7 is a cross-sectional, elevational view of a modification to the second embodiment of the invention.

FIG. 7 shows a modification to the second embodiment of the invention, in which a planter 135 and planter 137 are utilized in place of lid 120. In this way, the planter base 137 is sized and shaped to conform to the opening defined by the upper end 116 of housing 112. Means may be associated with the underside of lid/planter bash 137 for attaching the terminal end 121 of hose 115, such that when base 137 is removed from upper end 116 of housing 112, the terminal end (or handle) (not shown) attached thereto will be drawn out of interior 113 of housing 112. A grasping means 122 such as a finger aperture or handle may be associated with base 137 to facilitate the manipulation thereof.

Figure 8:
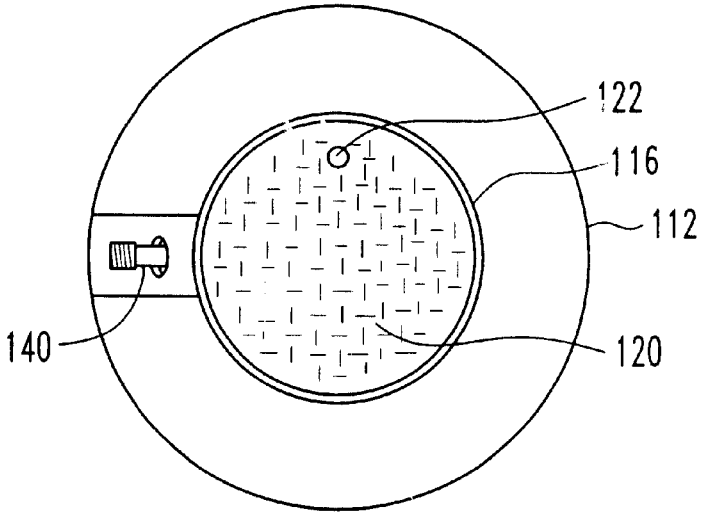
FIG. 8 is a top plan view of the second embodiment of the invention.
Figure 9:
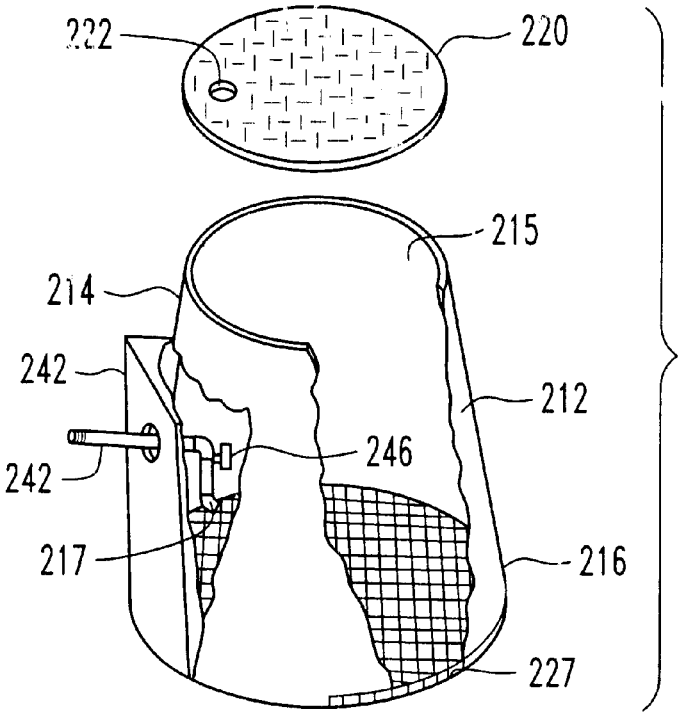
FIG. 9 is a perspective partial cut-away view of a third embodiment of the invention.
Figure 10:
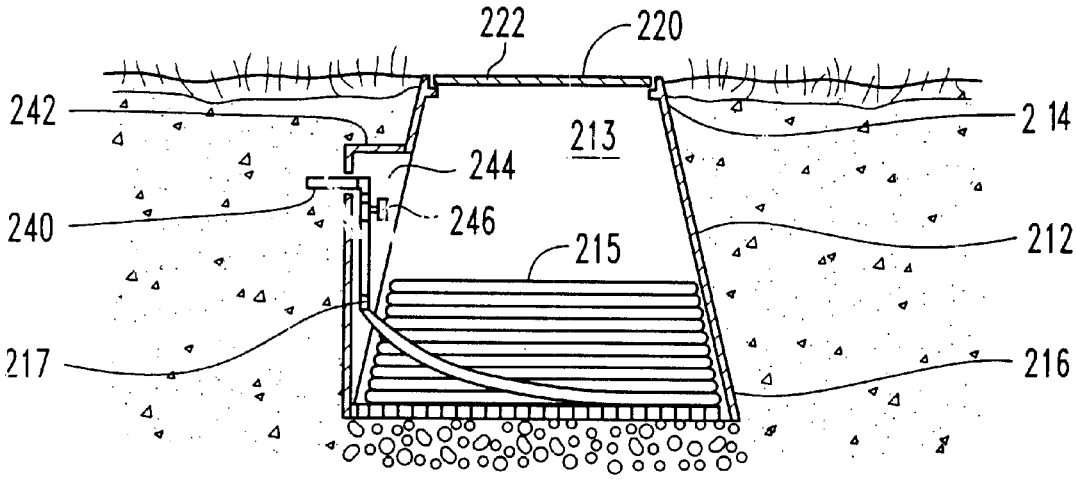
FIG. 10 is a cross-sectional, elevational view of the third embodiment of the invention.

Referring now to FIGS. 9–10, a third embodiment of the invention is shown in which a housing 212 defining a hollow interior 213 is provided. Housing 212 terminates in an upper open end 214 and a lower open end 216. A perforated floor 227, which for all embodiments of this invention may be a grate or other means for separating the interior 213 of housing 212 from the ground or other drainage medium there below is utilized. Water under pressure.is supplied via water inlet 240, and is regulated by valve 246. In this embodiment, water inlet supply 240 and valve 246 is removed from interior 213 of housing 212 by being placed within an auxiliary housing 242, which is connected to housing 212 such as is shown in FIGS. 8 and 9. In this way, hose 215, which is connected to water inlet 240 at coupling 217, does not interfere with the movement of hose 215 from or to housing 212 An opening in the sidewall of 212 adjacent auxiliary housing 242 and valve 246 permits a user to reach into interior 213 and acts as coupling 217 to connect hose 215 thereto and to manipulate valve 246.

Figure 11:
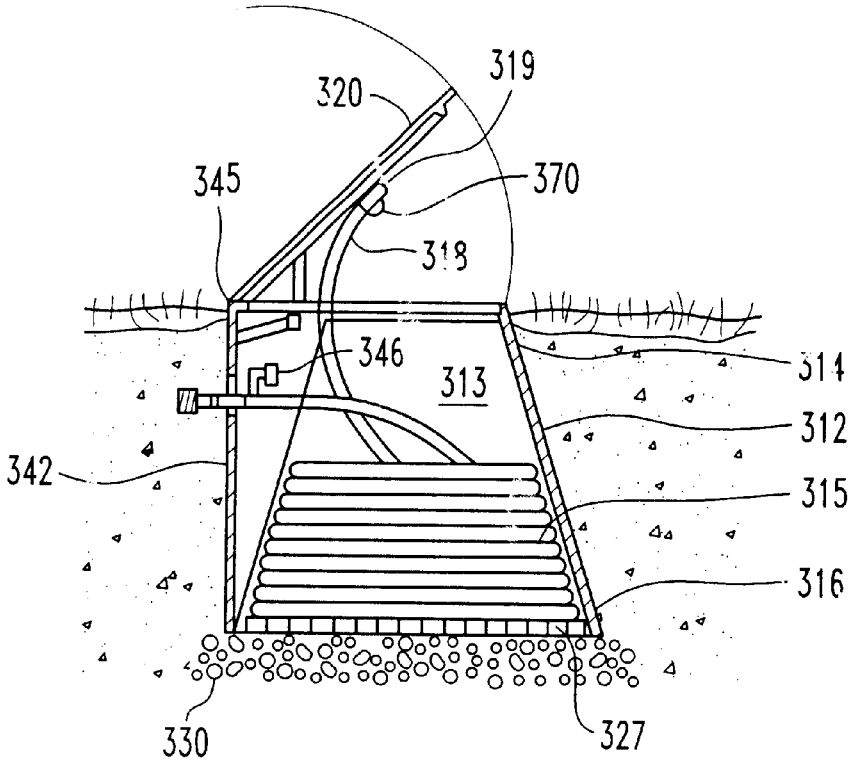
FIG. 11 is a cross-sectional, elevational view of a fourth embodiment of the invention.
Figure 12:
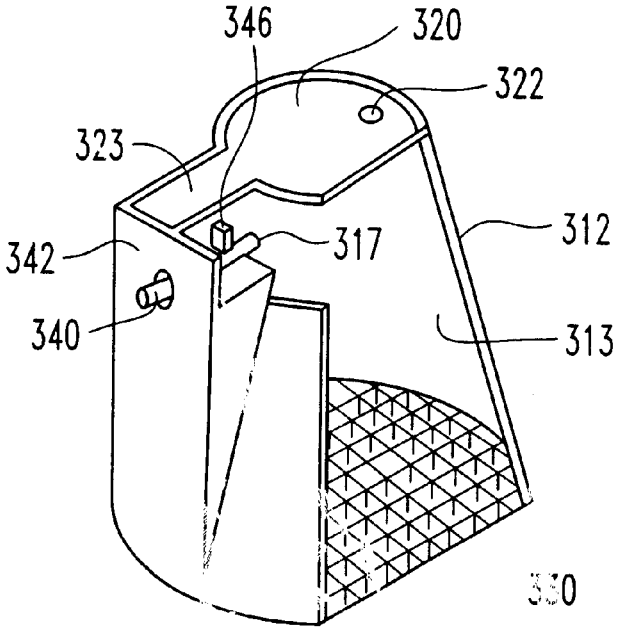
FIG. 12 is a perspective, partial cut-away view of the fourth embodiment of the invention.
Figure 13:
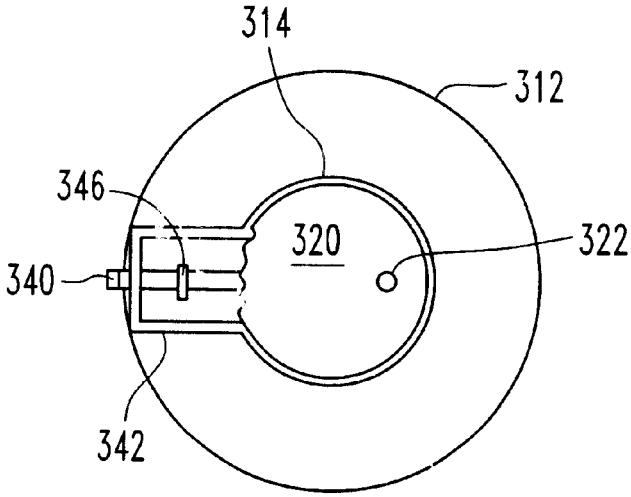
FIG. 13 is a to p plan view of the fourth embodiment of the invention.

Referring now to FIGS. 11–13, there is shown a fourth embodiment of the invention, which is identical in most respects to the embodiment of FIGS. 8–9 with the exception that the lid 320 in the fourth embodiment is hingedly connected to auxiliary housing 342 near an upper end thereof. Lid 320 defined at extension 323 which terminates in a hinge mechanism (not shown), which may be of any type which will occur to those of ordinary skill in the art. A grasping means 322 such as a finger aperture may be provided to assist in moving lid 320 between the closed position shown in FIGS. 12 and 13 and an open position, such as the partially open position shown in FIG. 11. Hose 315 can be spooled within the interior 313 of housing 312 and not be interfered with by valve 346 or conduit 340 due to auxiliary housing 342 a drainage means such as grate 327 and crushed stone 330 is utilized to support hose 315 within interior 313 yet permit drainage of water there through.

It should be noted that auxiliary housing 342, as well as auxiliary housing 242 in FIGS. 9–10, can be of any configuration. All that is deemed important by the inventors is that the side walls which define the interior 313 of housing 312 be generally free from obstructions upon which hose 315 can get snagged.

Having thus described the invention is its preferred embodiment, it will be clear that there is modifications may be made to the invention without departing from the spirit and scope of the invention as disclosed herein. It is not intended that the language used in describing the inventive concept nor the drawings illustrating the same be limiting on the invention. Rather, it is intended that the invention be limited only by the scope of the appended claims.

What is claimed is:

1. A method of storing and retrieving a flexible hose utilizing a hose storage device of the type which comprises a housing having an open top and an open bottom adapted to be placed underground with the top being substantially co-planar with a ground surface; the housing defining a hollow interior; a secondary housing integrally connected to the housing, said secondary housing defining a secondary cavity which is open to the interior of the housing; means for supplying water terminating within the secondary cavity and adapted to receive a proximal end of a garden hose; the interior of the housing being sized and shaped to receive a garden hose in spooled orientation about a vertical axis, the method comprising the steps of:

placing the housing within a correspondingly shaped hole in the ground;

orienting the open top of the housing to be substantially parallel to and co-extensive with the surface of the ground;

providing a water supply into the secondary cavity and terminating in a connection to which a proximal end of a hose to be stored within the housing may be connected;

connecting a proximal end of a hose to the water supply connection;

placing the hose into the housing within the ground in a spooled orientation about a vertical axis; and placing the cover over the open top of the housing.

2. The method of claim 1, further comprising the step of creating a french drain at a bottom of the hole in the ground adapted to be generally in registry with the open bottom of the housing when the housing is placed within the hole.

3. A hose storage system, comprising:

a generally cylindrical housing adapted to be mounted below the ground having tapering side walls such that the housing has an increasing internal diameter from top to bottom thereof;

an open top adapted to be covered by a correspondingly sized cover;

an open bottom to allow draining therefrom;

the housing having an interior cavity sized and shaped to receive a garden hose spooled about a horizontal axis during storage;

a secondary cavity associated with the housing and open to the interior of the housing in which is adapted to be situated a water supply to which a proximal end of the hose may be connected.

4. The hose storage system of claim 3, wherein the housing and secondary cavity are integrally formed together.

5. The hose storage system of claim 3, where the housing is tapered in a discontinuous manner in the form of a series of concentric rings and toroid sections.

6. A hose storage system, comprising:

a housing having an open top and an open bottom adapted to be placed within the ground with the top being substantially coplanar with the ground surface;

the housing defying a hollow interior;

a secondary housing integrally connected to the housing, said secondary housing defining a secondary cavity which is open to the interior of the housing;

means for supplying water terminating within the secondary housing and adapted to receive a proximal end of a garden hose;

the interior of the housing being sized and shaped to receive a garden hose in spooled orientation about a vertical axis.

7. The system of claim 6, wherein the housing is generally cylindrically shaped and oriented about the vertical axis.

8. The system of claim 7, wherein a diameter of a top of the housing is less than a diameter of the bottom of the housing.

9. The system of claim 6, further comprising a lid sized and shaped to fit over and substantially cover the open top of the housing and be substantially coplanar with the surrounding ground.

* * * * *